US011027814B2

(12) United States Patent
Adachi

(10) Patent No.: US 11,027,814 B2
(45) Date of Patent: Jun. 8, 2021

(54) SHIP REVERSE-RUN DETECTION SYSTEM, SHIP REVERSE-RUN DETECTION METHOD, AND RECORDING MEDIUM STORING SHIP REVERSE-RUN DETECTION PROGRAM

(71) Applicant: FUJITSU LIMITED, Kawasaki (JP)

(72) Inventor: Takayuki Adachi, Ebetsu (JP)

(73) Assignee: FUJITSU LIMITED, Kawasaki (JP)

( * ) Notice: Subject to any disclaimer, the term of this patent is extended or adjusted under 35 U.S.C. 154(b) by 195 days.

(21) Appl. No.: 16/054,297

(22) Filed: Aug. 3, 2018

(65) Prior Publication Data

US 2018/0354598 A1 Dec. 13, 2018

Related U.S. Application Data

(63) Continuation of application No. PCT/JP2016/054030, filed on Feb. 10, 2016.

(51) Int. Cl.

| | |
|---|---|
| ***B63H 25/00*** | (2006.01) |
| ***B63B 49/00*** | (2006.01) |
| ***B63H 25/04*** | (2006.01) |

(52) U.S. Cl.

CPC ..... *B63H 25/00* (2013.01); *B63B 49/00* (2013.01); *B63H 2025/045* (2013.01)

(58) Field of Classification Search

None

See application file for complete search history.

(56) References Cited

U.S. PATENT DOCUMENTS

| | | | | |
|---|---|---|---|---|
| 2012/0101668 | A1 | 4/2012 | Ioroi et al. | |
| 2015/0130643 | A1* | 5/2015 | Nagy | G08G 1/056 340/935 |
| 2018/0043976 | A1* | 2/2018 | Nakamoto | B63B 49/00 |

FOREIGN PATENT DOCUMENTS

| | | |
|---|---|---|
| EP | 0 921 411 A2 | 6/1999 |
| JP | 7-65299 | 3/1995 |
| JP | 11-165696 | 6/1999 |
| JP | 2006-137309 | 6/2006 |
| JP | 2012-86670 | 5/2012 |

OTHER PUBLICATIONS

Author: Accuracy of GPS Data; Title: Accuracy of GPS Data; Title Date: Dec. 27, 2015; Publisher: Wiki; Pertinent pp. 2 (Year; 2015).*
International Search Report dated Apr. 26, 2016 in corresponding International Patent Application No. PCT/JP2016/054030.

* cited by examiner

*Primary Examiner* — Rami Khatib
(74) *Attorney, Agent, or Firm* — Staas & Halsey LLP

(57) ABSTRACT

A ship reverse-run detection system includes a memory, and a processor coupled to the memory, wherein the processor is configured to: detect a direction of change in a position of a ship based on position information of the ship which is detected by a position detection device which is mounted on the ship, specify a traveling direction associated with a navigation region of the ship which is specified based on the position information, by referring to a storage which stores the navigation region and the traveling direction in association with each other, and detect reverse run of the ship in the navigation region based on the magnitude of an angle between the direction of the change and the traveling direction.

18 Claims, 8 Drawing Sheets

FIG. 3

13c

| MARINA ID | PORT DEPARTURE ID | SHIP ID | PORT DEPARTURE SCHEDULED DATE AND TIME | PORT ARRIVAL SCHEDULED DATE AND TIME | PORT DEPARTURE DATE AND TIME | PORT ARRIVAL DATE AND TIME |
|---|---|---|---|---|---|---|
| M001 | 01 | JP-ABC12345D404 | 2016/3/1 9:00 | 2016/3/1 15:00 | 2016/3/1 9:00 | 2016/3/1 14:30 |
| M001 | 02 | JP-DEF54321N505 | 2016/3/1 9:30 | 2016/3/1 16:00 | 2016/3/1 10:00 | - |
| M001 | 03 | JP-HIJ56789J123 | 2016/3/1 10:00 | 2016/3/1 16:00 | 2016/3/1 10:15 | - |
| M001 | 04 | JP-HIJ98765J200 | 2016/3/1 10:00 | 2016/3/1 15:30 | 2016/3/1 9:45 | - |
| ... | ... | ... | ... | ... | ... | ... |

| CURRENT POSITION | PORT DEPARTURE AND ARRIVAL STATUS | ALERT STATE |
|---|---|---|
| - | ARRIVED | - |
| 35.632454、139.853074 | DEPARTED | ANCHOR DRAGGING |
| 35.632460、139.853080 | DEPARTED | (ANCHORED) |
| 35.632465、139.853085 | DEPARTED | SHOAL WARNING |
| ... | ... | ... |

SHIP REVERSE-RUN DETECTION SYSTEM, SHIP REVERSE-RUN DETECTION METHOD, AND RECORDING MEDIUM STORING SHIP REVERSE-RUN DETECTION PROGRAM

CROSS-REFERENCE TO RELATED APPLICATION

This application is a continuation application of International Application PCT/JP2016/054030 filed on Feb. 10, 2016 and designated the U.S., the entire contents of which are incorporated herein by reference.

FIELD

The embodiments discussed herein relate to a ship reverse-run detection system, a ship reverse-run detection method, and a ship reverse-run detection program.

BACKGROUND

Technologies of notifying the navigation state of a ship to another ship include a ship automatic identification device.

Related technologies are disclosed in Japanese Laid-open Patent Publication No. 2012-86670.

SUMMARY

According to an aspect of the embodiments, a ship reverse-run detection system includes a memory, and a processor coupled to the memory, wherein the processor is configured to: detect a direction of change in a position of a ship based on position information of the ship which is detected by a position detection device which is mounted on the ship, specify a traveling direction associated with a navigation region of the ship which is specified based on the position information, by referring to a storage which stores the navigation region and the traveling direction in association with each other, and detect reverse run of the ship in the navigation region based on the magnitude of an angle between the direction of the change and the traveling direction.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

FIG. 3 is a diagram illustrating exemplary navigation data;

DESCRIPTION OF EMBODIMENTS

For example, in a ship automatic identification device using a universal shipborne automatic identification system (AIS), the AIS transmits ship information of the own ship to another ship, and upon reception of such ship information, the other ship displays information related to another ship on a display unit. The ship information includes the name and position information of a ship. It may be determined whether ship information has to be urgently received by referring to a sailing state such as a BLUE SIGN (binary data of information for notifying reverse run of a ship in a waterway to another ship).

However, this configuration only performs communication of ship information between ships. Thus, the configuration provides no method of detecting reverse run of a ship, and determination of reverse run is left to a crew member such as the operator of a ship.

For example, a ship reverse-run detection computer system capable of detecting reverse run of a ship may be provided.

The following describes embodiments of a ship reverse-run detection computer system, a ship reverse-run detection method, and a ship reverse-run detection program according to the embodiments with reference to the accompanying drawings. The embodiments do not limit the disclosed technology. The embodiments may be combined as appropriate while the contents of processing are maintained consistent.

Embodiment 1

[System Configuration]

Figure 1:
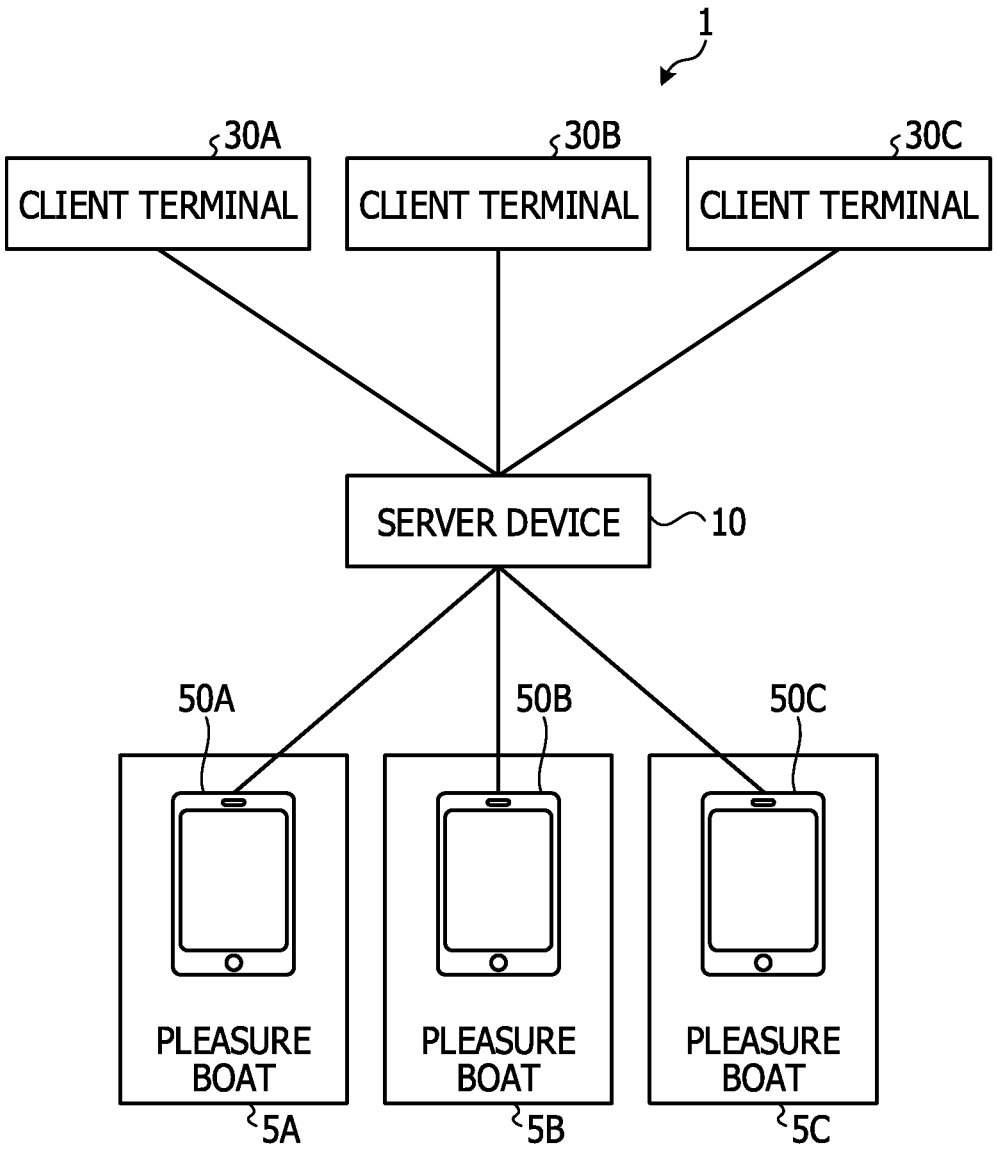
FIG. 1 is a diagram illustrating an exemplary configuration of a navigation management support system according to Embodiment 1.

FIG. 1 is a diagram illustrating an exemplary configuration of a navigation management support system according to Embodiment 1. In this navigation management support system 1 illustrated in FIG. 1, a user is a marina as a business operator who manages a port and provides navigation management service that manages operation of any ship belonging to the port. In the navigation management support system 1 illustrated in FIG. 1, an end user is a crew member of each ship belonging to the port, and the system provides the end user with navigation support service that supports safety navigation.

The navigation management service and the navigation support service are applicable to a ship of any classification, particularly to a small-sized ship, which makes the services further useful. Installation of a marine instrument such as an automatic identification system (AIS) is requested for large-sized ships, but not for small-sized ships. This situation makes it more difficult to provide navigation management and navigation support of small-sized ships, for example, ships used in marine leisure, which are called pleasure boats (5A to 5C) than those of large-sized ships.

Thus, the navigation management support system 1 utilizes, for the navigation management service and the navigation support service, functions of portable terminal devices 50A to 50C owned by crew members of the pleasure boats 5A to 5C, for example, ship operators thereof. Hereinafter, when collectively referred, the pleasure boats 5A to 5C are also referred to as a "pleasure boat 5".

The following exemplarily describes a case in which the navigation management service and the navigation support service are provided to the pleasure boat 5, but the navigation management service and the navigation support service may be provided to any other small-sized ship such as a fishing boat. In addition, the navigation management service and the navigation support service may be provided to any large-sized ship by exploiting the existing technology such as AIS.

As illustrated in FIG. 1, the navigation management support system 1 includes a server device 10, client terminals 30A to 30C, and the portable terminal devices 50A to 50C. Hereinafter, when collectively referred, the client terminals 30A to 30C are also referred to as a "client terminal 30". When collectively referred, the portable terminal devices 50A to 50C are also referred to as a "portable terminal device 50". Although FIG. 1 exemplarily illustrates a configuration in which the server device 10 houses the three client terminals 30 and the three portable terminal devices 50, the present disclosure is not limited to the illustrated example. The server device 10 may house an optional number of client terminals 30 and an optional number of portable terminal devices 50.

The server device 10 is a computer configured to provide the navigation management service to the client terminal 30.

According to an embodiment, the server device 10 may be implemented by installing, to a desired computer, a navigation management program configured to achieve the navigation management service as package software or online software. For example, the server device 10 may be implemented as a Web server configured to provide the navigation management service or may be implemented as a cloud configured to provide the navigation management service by outsourcing.

The client terminal 30 is a computer configured to receive provision of the navigation management service from the server device 10. The client terminal 30 may be used by, for example, any person concerned with the marina such as a staff or manager of the marina.

According to the embodiment, the client terminal 30 may be achieved by a personal computer. The client terminal 30 is not limited to a stationary information processing device such as a personal computer as described above, but may be various portable terminal devices that the marina lends to a person concerned therewith. Examples of the "portable terminal devices" include mobile communication terminals such as a smartphone, a cellular phone, and a personal handyphone system (PHS) phone, a slate terminal, and a tablet terminal.

For example, the client terminal 30 receives request for login to the server device 10 by receiving inputting of account information allocated to the marina, for example, an identification (ID) and a password. When this login request is transmitted from the client terminal 30 to the server device 10, the server device 10 executes login authentication. When the login authentication is successful, the navigation management service related to the marina is released to the client terminal 30 having succeeded the login authentication.

The server device 10 and the client terminal 30 are connected with each other through a predetermined network. Examples of such a network include optional kinds of wired and wireless communication networks such as the Internet, a local area network (LAN), and a virtual private network (VPN).

The portable terminal device 50 is used as a computer configured to provide the navigation support service. The "portable terminal device 50" is, for example, that used by a crew member such as the ship operator of the pleasure boat 5.

According to the embodiment, an application program configured to achieve the navigation support service is installed on the portable terminal device 50. Hereinafter, such an application program configured to achieve the navigation support service is also referred to as a "navigation support App". The portable terminal device 50 performs, by executing the navigation support App through a processor thereof, various warnings that contribute to safety navigation as exemplary navigation support service.

As an aspect of the navigation support service, for example, the portable terminal device 50 automatically or manually notifies the server device 10 of departure and arrival of the pleasure boat 5 that the ship operator holding the portable terminal device 50 is on board from and at a ship port. This provides such port departure and arrival determination service that the notification of port departure and arrival of the pleasure boat 5 is output through a predetermined display device or a voice output device or the port departure and arrival notification of the pleasure boat 5 is uploaded to the server device 10 to record port departure and arrival in the server device 10. In addition, the portable terminal device 50 performs, over a sailing duration between port departure and arrival of the pleasure boat 5, various kinds of warnings such as a warning related to dangerous objects such as a shoal, a reef, and a fishing net, a warning related to ship operation exceeding a navigation range of the pleasure boat 5 determined based on skills and a license of the ship operator of the pleasure boat 5, the size of the boat, and the like, a warning related to entry to a restricted region such as a port or a river, a warning related to anchor dragging to the pleasure boat 5 performing anchoring, a warning related to reverse-run of a course, and a warning related to approach of all kinds of other ships including small-sized and large-sized ships.

As another aspect, the portable terminal device 50 uploads, only during the above-described sailing duration, position information measured by a position detection unit, such as a global positioning system (GPS) receiver, included in the portable terminal device 50 to the server device 10. Accordingly, the portable terminal device 50 establishes a foundation that allows the server device 10 to provide the navigation management service to the client terminal 30. The server device 10 is capable of managing, based on the foundation, for example, port departure and arrival of the pleasure boat 5 and the current position after port departure of the pleasure boat 5. In addition, the server device 10 is capable of receiving an emergency request for rescue of the pleasure boat 5 from the portable terminal device 50, setting, on a map including a port under jurisdiction of the marina and a marine area around the port, a symbol of a dangerous object for which the portable terminal device 50 sets off a warning, and displaying, in a display manner different from those of other symbols, a symbol of the pleasure boat 5 for which the portable terminal device 50 is executing the above-described various warnings among symbols of ships indicated on the map. Hereinafter, a port under jurisdiction of the marina and a marine area around the port are also referred to as a "jurisdiction zone".

Communication is performed between the server device 10 and the portable terminal device 50 through an optional network connected through a base station in which the portable terminal device 50 is housed. Although not illustrated, communication is performed between the client terminal 30 and the portable terminal device 50 in a similar manner.

[Configuration of Server Device 10]

Figure 2:
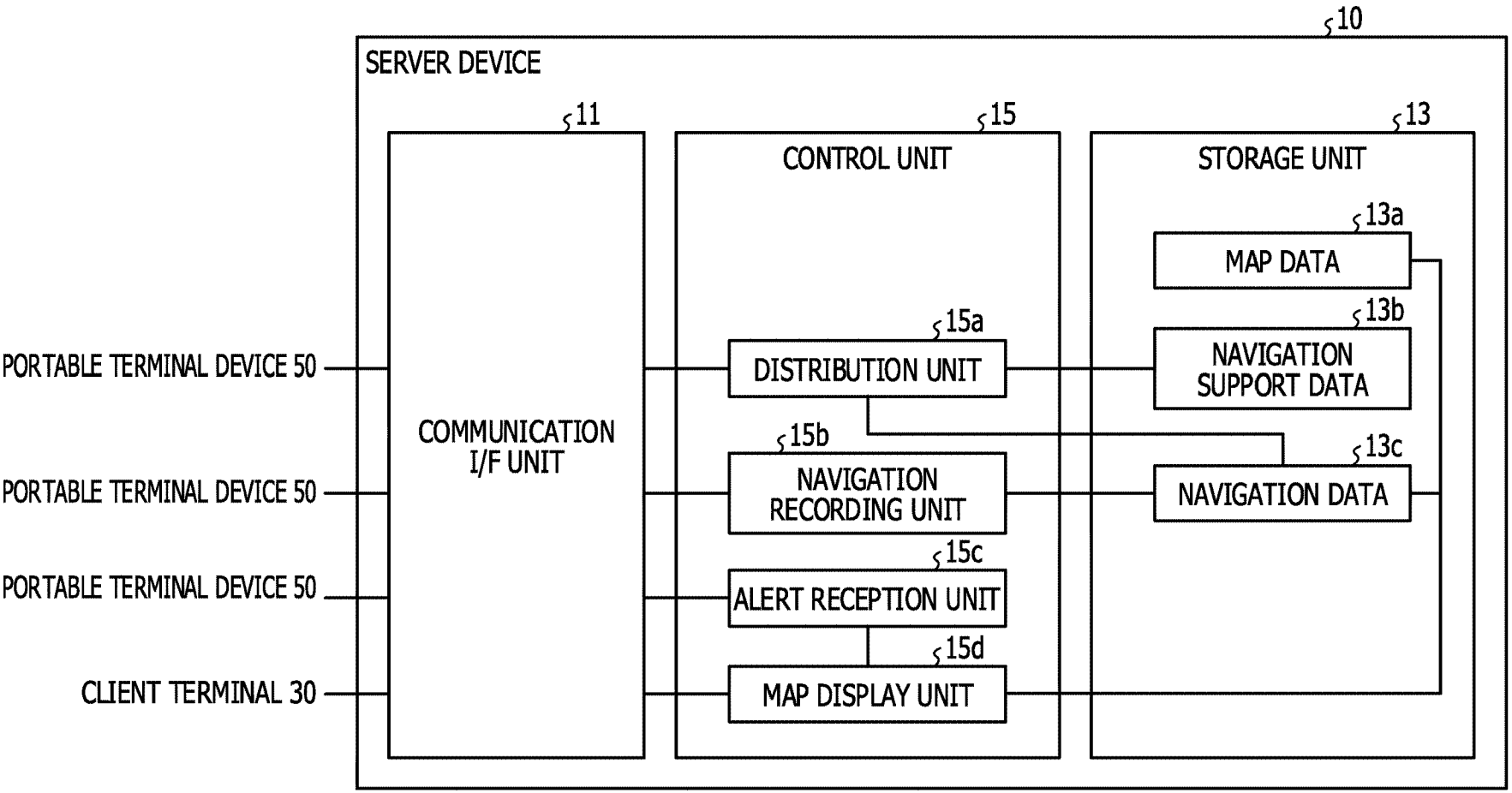
FIG. 2 is a block diagram illustrating a functional configuration of a server device according to Embodiment 1.

FIG. 2 is a block diagram illustrating a functional configuration of the server device 10 according to Embodiment 1. As illustrated in FIG. 2, the server device 10 includes a communication I/F unit 11, a storage unit 13, and a control unit 15. FIG. 2 illustrates a solid line indicating a data inputting and outputting relation only in a minimum part for the purpose of illustration. In other words, data inputting and outputting related to each processing unit is not limited the illustrated example, but any other data inputting and outputting such as data inputting and outputting between processing units, between a processing unit and data, and between a processing unit and an external device may be performed.

The communication I/F unit 11 is an interface configured to control communication with another device such as the client terminal 30 or the portable terminal device 50.

According to the embodiment, as an aspect, the communication I/F unit 11 may be achieved by a network interface card such as a LAN card. For example, the communication I/F unit 11 receives a request to browse a monitoring screen from the client terminal 30, and transmits, to the client terminal 30, display data of a monitoring screen including a map related to the jurisdiction zone of the marina. In addition, the communication I/F unit 11 receives a request to download the navigation support APP from the portable terminal device 50, position information of the pleasure boat 5, and an alert output status at the portable terminal device 50, and transmits, for example, data of the navigation support APP and navigation support data including course data to the portable terminal device 50.

The storage unit 13 is a storage device configured to store data used by various computer programs such as an operating system (OS) executed at the control unit 15 and an application program that achieves the navigation management service.

According to the embodiment, the storage unit 13 may be provided as an auxiliary storage device of the server device 10. For example, the storage unit 13 may be achieved by a hard disk drive (HDD), an optical disk, or a solid state drive (SSD). The storage unit 13 does not necessarily have to be provided as an auxiliary storage device, but may be provided as a main storage device of the server device 10. In this case, the storage unit 13 may be achieved by various semiconductor memory elements such as a random access memory (RAM) and a flash memory.

The storage unit 13 stores, as exemplary data used by a computer program executed at the control unit 15, map data 13*a*, navigation support data 13*b*, and navigation data 13*c*. In addition to the map data 13*a*, the navigation support data 13*b*, and the navigation data 13*c*, the storage unit 13 may store property information related to a ship, such as information in which a ship name, a captain name, the number of crew members are associated with each other for each ship number. Among the map data 13*a*, the navigation support data 13*b*, and the navigation data 13*c*, the navigation support data 13*b* will be described at a situation in which the navigation support data 13*b* is referred to.

The map data 13*a* is electronic data of a marine chart. The marine chart is, for example, a general chart, sailing chart, a nautical chart, a coast chart, or a harbor chart. All or some of these charts are stored in the storage unit 13 as the map data 13*a*. The map data 13*a* includes pieces obtained by dividing, in mesh, the entire map included in the map data 13*a*. Thus, when the server device 10 transmits the map data 13*a* to the client terminal 30 or the portable terminal device 50, not the entire map included in the map data 13*a* has to be transmitted, but only part of the map data 13*a* may be transmitted. For example, when the map data 13*a* is transmitted from the server device 10 to the client terminal 30, map data of the jurisdiction zone corresponding to the client terminal 30 or an element corresponding to part of the jurisdiction zone is extracted from the map data 13*a* and then transmitted. When the map data 13*a* is transmitted from the server device 10 to the portable terminal device 50, map data of an element corresponding to a predetermined range with respect to position information specified by the portable terminal device 50, in other words, a current position is extracted from the map data 13*a* and then transmitted.

The navigation data 13*c* is data related to navigation.

According to the embodiment, the navigation data 13*c* may be data including items such as a marina ID, a port departure ID, a ship ID, a port departure scheduled date and time, a port arrival scheduled date and time, a port departure date and time, a port arrival date and time, and a current position. The "marina ID" is identification information of the marina, and may be, for example, any optional system identifier as information that allows the server device 10 to identify the marina. The "port departure ID" is information for identifying a ship departing from the port managed by the marina, and is allocated with a number in the order of port departure notice submission among port departure notices having the same date of the port departure scheduled date and time. The "ship ID" is information for identifying a ship, and may be, for example, a ship number provided to the ship. The ship number is also called a "ship identification number".

Values may be registered to the items of the "port departure ID", the "ship ID", the "port departure scheduled date and time", and the "port arrival scheduled date and time", for example, when a port departure notice is submitted to the marina. For example, when a port departure notice is received online by the marina, or when a port departure notice is received online by, on behalf of the marina, a business operator that provides the navigation management service and the navigation support service, the port departure ID, the ship ID, the port departure scheduled date and time, and the port arrival scheduled date and time that are included in electronic data of the port departure notice in association with the marina ID of the marina to which the port departure notice is submitted may be registered to the storage unit 13.

Only when a port departure notification is received from the portable terminal device 50, the date and time of the reception of the port departure notification is registered to the "port departure date and time". Only when a port arrival notification is received from the portable terminal device 50, the date and time of the reception of the port arrival notification is registered to the "port arrival date and time". The "current position" is overwritten with position information uploaded from the portable terminal device 50, a status related to port departure and arrival of which is set to "departed", at each uploading in a predetermined duration, for example, one minute.

FIG. 3 is a diagram illustrating exemplary navigation data 13*c*. FIG. 3 only illustrates, as an example, records related to a marina identified by the marina ID of "M001". The exemplary navigation data 13*c* illustrated in FIG. 3 indicates that a ship identified by the ship ID of "JP-ABC12345D404" departed from the marina identified by the marina ID of "M001" and has already arrived at the marina. The exemplary navigation data 13*c* illustrated in FIG. 3 also indicates that a ship identified by the ship ID of "JP-DEF54321N505", a ship identified by the ship ID of "JP-HIJ56789J123", and a ship identified by the ship ID of "JP-HIJ98765J200" have departed from the marina identified by the marina ID of "M001". An alert of "anchor dragging" is output to the ship identified by the ship ID of "JP-DEF54321N505", and an alert of "shoal warning" is output to the ship identified by the ship ID of "JP-HIJ98765J200". No alert is output to the ship identified by the ship ID of "JP-HIJ56789J123", but a notification that the ship has been anchored, in other words, moored has been uploaded.

The above-described table is exemplary, and may have, for example, no status column or may store an additional item other than the status column. When the kind of alert is received from a data communication unit 58*e* to be described later, the kind of alert may be stored as an alert state in association with a ship ID. As long as the above-described data items are allowed to be stored in association with each other and referred to, data does not have to be collectively stored in a single table but may be managed in a divided manner in a plurality of tables.

The control unit 15 includes an internal memory configured to store various computer programs and various kinds of control data, and executes various kinds of processing based on these computer programs and control data.

According to the embodiment, the control unit 15 is achieved as a central processing unit (CPU). the control unit 15 does not necessarily have to be achieved as a central processing unit, but may be achieved as a micro processing unit (MPU). Alternatively, the control unit 15 may be achieved by a hard-wired logic such as an application specific integrated circuit (ASIC) or a field programmable gate array (FPGA).

The control unit 15 virtually achieves processing units described below by loading, as a process onto a work area of a RAM, such as a dynamic random access memory (DRAM) or a static random access memory (SRAM), mounted as a main storage device (not illustrated), the navigation management program stored in the storage unit 13 as an application program that achieves the above-described the navigation management service.

For example, as illustrated in FIG. 2, the control unit 15 includes a distribution unit 15*a*, a navigation recording unit 15*b*, an alert reception unit 15*c*, and a map display unit 15*d*.

The distribution unit 15*a* is a processing unit configured to perform distribution to the portable terminal device 50.

According to the embodiment, when having received, from the portable terminal device 50, a request to download the navigation support App, the distribution unit 15*a* distributes the navigation support data 13*b* stored in the storage unit 13 to the portable terminal device 50. The navigation support data 13*b* includes the data of the navigation support App and various kinds of data to be used by the navigation support App. Examples of the data to be used by the navigation support APP include navigation data in which a navigation region on a course is associated with a traveling direction. The navigation region may be defined by position information of a buoy disposed on a course in accordance with navigation rules.

Figure 5:
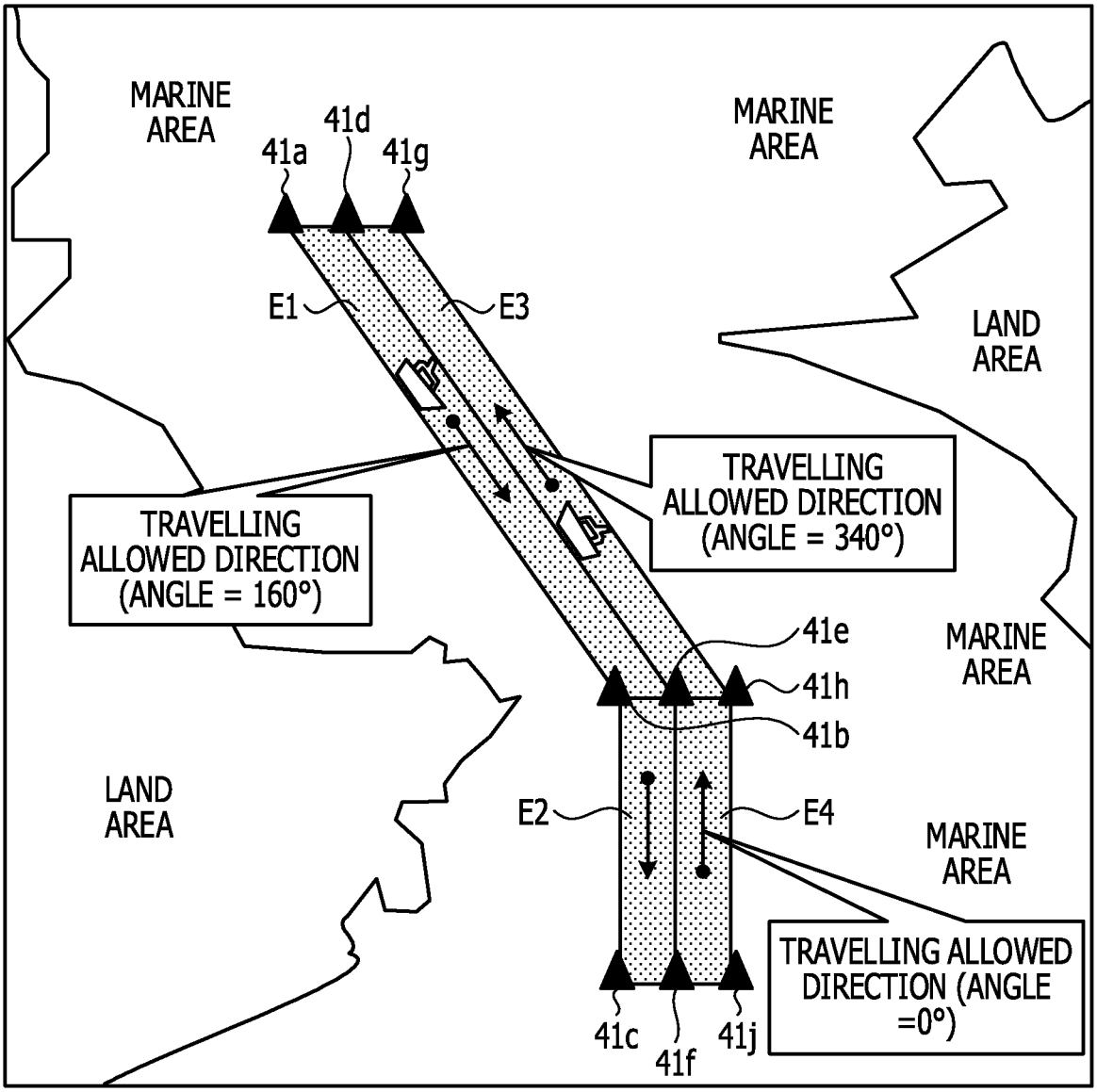
FIG. 5 is a pattern diagram of a marine chart including a course.

FIG. 5 is a pattern diagram of a marine chart including a course. FIG. 5 only includes a buoy used to define a navigation region among buoys disposed on the course. For example, a navigation region is defined by a polygon by using position information of a plurality of buoys. In the example illustrated in FIG. 5, a navigation region E1 is defined by the position information of a buoy 41*a*, a buoy 41*b*, a buoy 41*e*, and a buoy 41*d*, and a navigation region E2 is defined by the position information of the buoy 41*b*, a buoy 41*c*, a buoy 41*f*, and the buoy 41*e*. The navigation regions E1 and E2 are included in a south sailing route according to the navigation rules. For example, when an azimuth is defined in the clockwise direction with 0° at the up direction, which is North, in the marine chart, the navigation region E1 is associated with a traveling direction of 160° and the navigation region E2 is associated with a traveling direction of 180° according to the above-described navigation rules. In addition, a navigation region E3 is defined by the position information of the buoy 41*d*, the buoy 41*e*, a buoy 41*h*, and a buoy 41*g*, and a navigation region E4 is defined by position information of the buoy 41*e*, the buoy 41*f*, a buoy 41*j*, and the buoy 41*h*. The navigation regions E3 and E4 are included in a north sailing route according to the navigation rules. Accordingly, the navigation region E3 is associated with a traveling direction of 340°, and the navigation region E4 is associated with a traveling direction of 0°. Thus, the course illustrated in FIG. 5 is defined by a record associating the navigation region E1 with the traveling direction of "160°", a record associating the navigation region E2 with the traveling direction of "180°", a record associating the navigation region E3 with the traveling direction of "340°", and a record associating the navigation region E4 with the traveling direction of "0°". FIG. 5 illustrates the example in which each navigation region is defined by a rectangle, but any polygon may be defined.

The navigation recording unit 15*b* is a processing unit configured to perform recording related to navigation.

According to the embodiment, when having received a port departure notification from the portable terminal device 50, the navigation recording unit 15*b* executes processing as follows. Specifically, the navigation recording unit 15*b* records the date and time of reception of the port departure notification to the port departure date and time of a record having a marina ID and a port departure ID identical to those included in the port departure notification among records stored as the navigation data 13*c* in the storage unit 13. In this example, it is assumed that duplicate port departure IDs are allocated to marinas, and both of a marina ID and a port departure ID are used to search records. However, the record search may be performed by only using the port departure ID when different port departure IDs are allocated to marinas. When having received a port arrival notification from the portable terminal device 50, the navigation recording unit 15*b* executes processing as follows. Specifically, the navigation recording unit 15*b* records the date and time of reception of the port arrival notification to the port arrival date and time of a record having a marina ID and a port departure ID identical to those included in the port arrival notification among records stored as the navigation data 13*c* in the storage unit 13. The navigation recording unit 15*b* also executes processing as follows each time position information is notified from the portable terminal device 50. Specifically, the navigation recording unit 15*b* overwrites and updates the position information with the current position of a record having a marina ID and a port departure ID identical to those notified together with the position information among records stored as the navigation data 13*c* in the storage unit 13.

The alert reception unit 15*c* is a processing unit configured to receive an alert execution notification from the portable terminal device 50.

According to the embodiment, when an alert is output at the portable terminal device 50, the alert reception unit 15*c* receives, from the portable terminal device 50, an alert execution notification including the kind of the alert output at the portable terminal device 50.

The map display unit 15*d* is a processing unit configured to cause the client terminal 30 display a map.

According to the embodiment, when a request to browse a monitoring screen is received on a menu screen (not illustrated) displayed on the client terminal 30, the map display unit 15*d* executes processing as follows. For example, the map display unit 15*d* specifies a marina ID from an account used, at login authentication, by the client terminal 30 having issued a request to browse the monitoring screen. Subsequently, the map display unit 15*d* further specifies a jurisdiction zone corresponding to the specified marina ID by referring to jurisdiction data (not illustrated) in which the marina ID of each marina is associated with the jurisdiction zone of the marina. Then, the map display unit 15*d* extracts, from the map data 13*a* stored in the storage unit 13, map data including the jurisdiction zone corresponding to the specified marina ID. Thereafter, the map display unit 15*d* causes the client terminal 30 to display a monitoring screen including the extracted map of the jurisdiction zone of the marina.

For example, any record having a registered current position is extracted from among records included in the navigation data 13*c*, and then the current position of any ship included in the record may be mapped on the map of the jurisdiction zone of the marina included in the above-described monitoring screen. When the current position of a ship is mapped in this manner, the client terminal 30 may display, for example, property information related to the ship in association with a symbol indicating the ship. The property information of a ship may be displayed on a window different from the monitoring screen. Moreover, among symbols of ships mapped on the map of the jurisdiction zone of the marina, the symbol of a ship from which an alert execution notification is received by the alert reception unit 15*c* may be displayed on the monitoring screen in a display manner different from that for the symbol of any other ship. In this case, the symbol of this ship may be displayed in a display manner that further differs between the kinds of outputting on the portable terminal device 50.

[Configuration of Portable Terminal Device 50]

Figure 4:
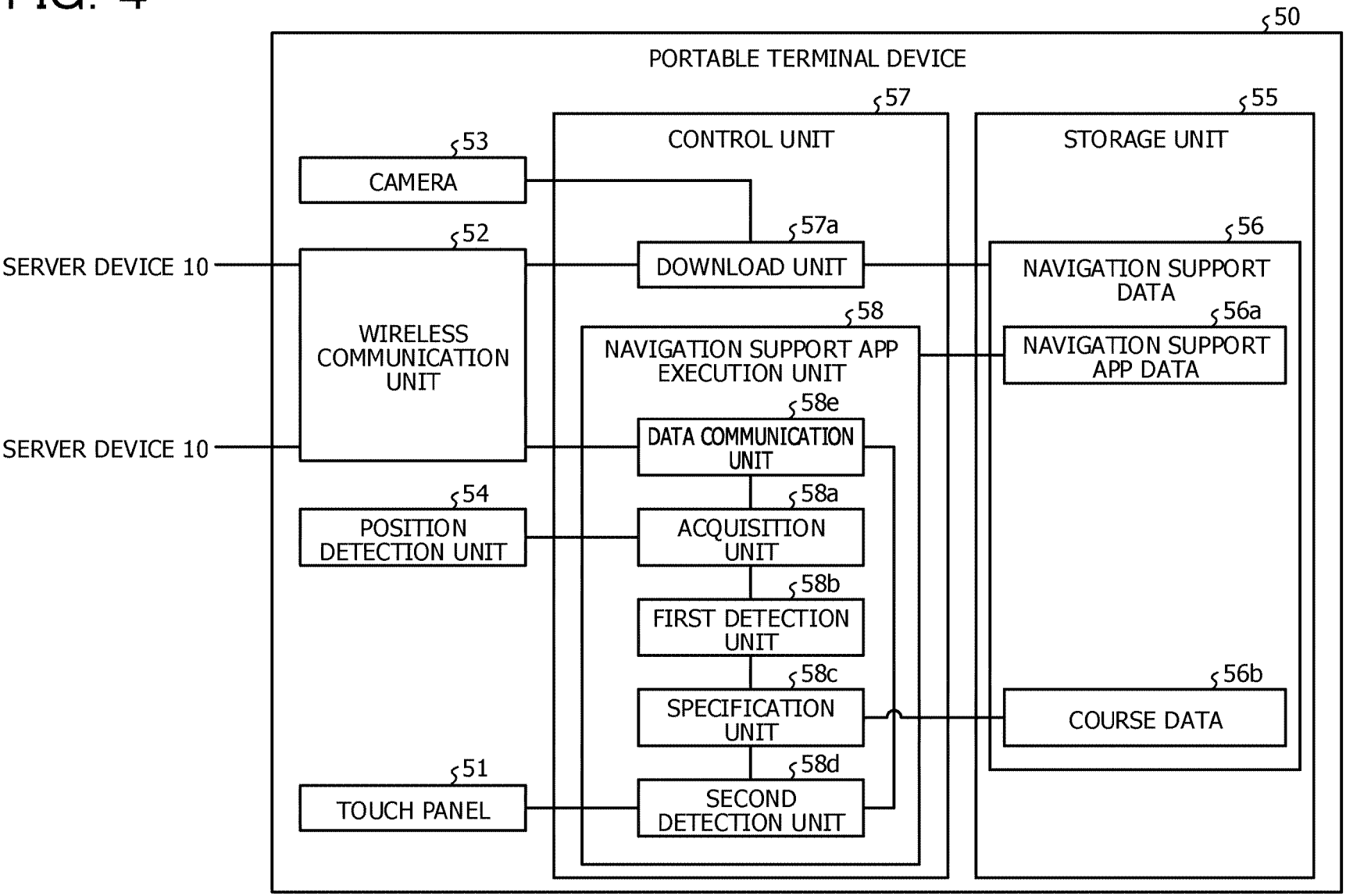
FIG. 4 is a block diagram illustrating a functional configuration of a portable terminal device according to Embodiment 1.

FIG. 4 is a block diagram illustrating a functional configuration of the portable terminal device 50 according to Embodiment 1. As illustrated in FIG. 4, the portable terminal device 50 includes a touch panel 51, a wireless communication unit 52, a camera 53, a position detection unit 54, a storage unit 55, and a control unit 57. The portable terminal device 50 may include various functional components, such as a voice output unit, included in a known portable terminal device in addition to functional components illustrated in FIG. 4.

The touch panel 51 is a device capable of performing display and receiving inputting.

As an aspect related to display, the touch panel 51 displays images output from an OS executed on the portable terminal device 50 and an application program such as the navigation support App. As an aspect related to input, the touch panel 51 receives touch operations such as tap, flick, swipe, pinch-in, and pinch-out performed on a screen of the touch panel 51. In this example, the touch panel 51 is described as an exemplary display unit, but does not necessarily have to provide both displaying and inputting functions. The touch panel 51 may be achieved individually by a display device and an input device.

The wireless communication unit 52 is a processing unit configured to connect with the base station through an antenna (not illustrated) to perform data transmission and reception to and from any other device such as the server device 10 through, for example, a mobile communication network connected with the base station.

The camera 53 is an image capturing apparatus configured to capture images.

According to the embodiment, the camera 53 includes an image sensor such as a charge coupled device (CCD) or a complementary metal oxide semiconductor (CMOS). For example, the camera 53 may include light receiving elements of three kinds such as R (red), G (green), and B (blue).

The position detection unit 54 is a kind of hardware configured to detect the position of the portable terminal device 50.

According to the embodiment, the position detection unit 54 may be a GPS receiver configured to detect a position based on time information transmitted from a plurality of GPS satellites. The position detected by the GPS receiver in this manner does not necessarily have to be directly used, but may be subjected to various kinds of correction by using, for example, position information transmitted from the base station connected with the portable terminal device 50.

The storage unit 55 is a storage device configured to store the OS executed by the control unit 57 and data used by various computer programs such as application programs.

According to the embodiment, the storage unit 55 may be provided as a main storage device of the server device 10. For example, the storage unit 55 may be achieved by various semiconductor memory elements such as a RAM such as a DRAM or a SRAM and a flash memory. The storage unit 55 does not necessarily have to be provided as a main storage device, but may be provided as an auxiliary storage device of the portable terminal device 50. In this case, the storage unit 55 may be achieved by a HDD, an optical disk, or a SSD.

The storage unit 55 stores, as exemplary data used by a computer program executed by the control unit 57, navigation support data 56. In addition to the navigation support data 56, the storage unit 55 may store user data of the portable terminal device 50.

The control unit 57 is a processing unit configured to govern entire control of the portable terminal device 50.

According to the embodiment, the control unit 57 is provided as a central processing unit (CPU). The control unit 57 does not necessarily have to be provided as a central processing unit, but may be provided as an MPU. The control unit 57 may be achieved by a hard-wired logic such as an ASIC or an FPGA.

As illustrated in FIG. 4, the control unit 57 includes a download unit 57*a* and a navigation support App execution unit 58.

The download unit 57*a* is a processing unit configured to execute various kinds of downloading.

The following describes an exemplary method of downloading the navigation support App installed on the portable terminal device 50. For example, downloading of the above-described navigation support App starts when a two-dimensional bar code issued by the marina is read through the camera 53 of the portable terminal device 50. Such a two-dimensional bar code is read, for example, when a port departure notice is submitted to the marina. Once the port departure notice is submitted to the marina in this manner, a port departure ID is allocated by the server device 10, and then a new record in which, for example, the port departure ID, the marina ID of the marina having received the port departure notice, a ship ID, a port departure scheduled date and time, and a port arrival scheduled date and time received through the port departure notice are associated with each other is generated in the navigation data 13*c*. Thereafter, address information such as a uniform resource locator (URL) through which the server device 10 is accessed, the marina ID, and the port departure ID are coded. In this manner, a two-dimensional bar code including the marina ID and the port departure ID is generated. Thereafter, the two-dimensional bar code including the URL, the marina ID, and the port departure ID is read by capturing, through the camera 53, a sheet on the two-dimensional bar code is output by printing or a screen of a display device on which the two-dimensional bar code is displayed.

When the two-dimensional bar code including the URL, the marina ID, and the port departure ID is read in this manner, the download unit 57*a* transmits, by referring to the address of the URL, a request to download the navigation support App including the marina ID and the port departure ID to the server device 10. As a result, the navigation support App data 56*a* included in the navigation support data 13*b*, and navigation support data including various kinds of data (for example, the course data 56*b*) used by the navigation support App are downloaded as the navigation support data 56 from the server device 10. In addition, for example, the marina ID and the port departure ID are registered to the storage unit 55 for identification of a marina to which the pleasure boat 5 belongs and the pleasure boat 5 itself by the server device 10. Thereafter, the download unit 57*a* activates the navigation support App data 56*a* downloaded from the server device 10 by loading the navigation support App execution unit 58 onto a work area of a RAM such as the storage unit 55.

The activation of the navigation support App allows the portable terminal device 50 to start providing the navigation support service. After the activation at the portable terminal device 50, the navigation support App continues operating on background until completion of port departure and port arrival submitted through the port departure notice, irrespective of any operation to end the navigation support App by a user.

As illustrated in FIG. 4, the navigation support App execution unit 58 includes an acquisition unit 58*a*, a first detection unit 58*b*, a specification unit 58*c*, a second detection unit 58*d*, and the data communication unit 58*e*.

The acquisition unit 58*a* is a processing unit configured to acquire position information.

According to the embodiment, the acquisition unit 58*a* acquires position information from the position detection unit 54 at each position detection by the position detection unit 54. The acquired position information is, for example, latitude and longitude coordinates. The following description assumes an example in which position information sampled in predetermined period, for example, five seconds by the position detection unit 54 is acquired.

The first detection unit 58*b* is a processing unit configured to detect a direction in which the position of the pleasure boat 5 changes.

According to the embodiment, at each acquisition of position information by the acquisition unit 58*a*, the first detection unit 58*b* executes processing as follows. Specifically, the first detection unit 58*b* refers to the course data 56*b* stored as the navigation support data 56 in the storage unit 55. Then, the first detection unit 58*b* determines whether the position information acquired by the acquisition unit 58*a* is included in a navigation region included in the course data 56*b*. When the position information is included in a navigation region included in the course data 56*b*, it is identified that the current position of the pleasure boat 5 is in a course. In this case, the first detection unit 58*b* detects the direction of change in the position of the pleasure boat 5 based on the position information acquired by the acquisition unit 58*a* and position information acquired by the acquisition unit 58*a*, for example, 30 seconds before the position information. In this exemplary description, the position information acquired 30 seconds before, in other words, six frames before is used to detect the direction of change in the position of the pleasure boat 5, but any position information acquired in the past, namely, position information acquired N frames (N is a natural number) before may be used.

The specification unit 58*c* is a processing unit configured to specify the traveling direction of the pleasure boat 5.

According to the embodiment, when the position information acquired by the acquisition unit 58*a* is included in a navigation region included in the course data 56*b*, the specification unit 58*c* specifies, by referring to the course data 56*b*, the traveling direction of a course associated with the navigation region in which the position information is included.

The second detection unit 58*d* is a processing unit configured to detect reverse run of the pleasure boat 5 in a navigation region.

According to the embodiment, the second detection unit 58*d* calculates an angle between the traveling direction of the course specified by the specification unit 58*c* and the direction of change in the position of the pleasure boat 5 detected by the first detection unit 58*b*. The angle indicates an angle at which the moving direction of the pleasure boat 5 deviates from the traveling direction of the course, and thus is also referred to as a "course deviation angle". Then, the second detection unit 58*d* determines whether the course deviation angle is equal to or larger than a predetermined threshold, for example, 90°. When the course deviation angle is equal to or larger than the threshold, it is estimated that the pleasure boat 5 is likely to be reversely running the course. In this case, the second detection unit 58*d* outputs a message telling reverse run in the course as an alert through display on the touch panel 51, or outputs a sound effect telling reverse run in the course or the above-described message as an alert by voice through a speaker (not illustrated) or the like. The threshold is 90° in this example, but may be 160° or 165° to reduce the occurrence of false reverse-run detection due to error in positioning by the GPS receiver.

In addition, the second detection unit 58*d* may set a course reverse-run distance to be the distance between the position information acquired by the acquisition unit 58*a* and position information acquired by the acquisition unit 58*a*, for example, 30 seconds before the position information, and may further determine whether the course reverse-run distance is equal to or larger than a predetermined threshold, for example, 30 m. Then, an alert related to course reverse run may be output only when the course reverse-run distance is equal to or larger than the threshold.

According to another embodiment, the second detection unit 58*d* calculates an angle identified as a direction opposite to the traveling direction of the course in accordance with the traveling direction of the course specified by the specification unit 58*c*. Hereinafter, the angle identified as a direction opposite to the traveling direction of the course is also referred to as a "reverse-run identification angle". In accordance with the reverse-run identification angle, the second detection unit 58*d* sets a range in which the moving direction of the pleasure boat 5 is identified to be opposite to the traveling direction of the course with respect to position information acquired by the acquisition unit 58*a*, for example, 30 seconds before the position information acquisition by the acquisition unit 58*a*. Hereinafter, the range in which the pleasure boat 5 is identified to be moving in the direction opposite to the traveling direction of the course is also referred to as a "reverse-run identification range".

Figure 6:
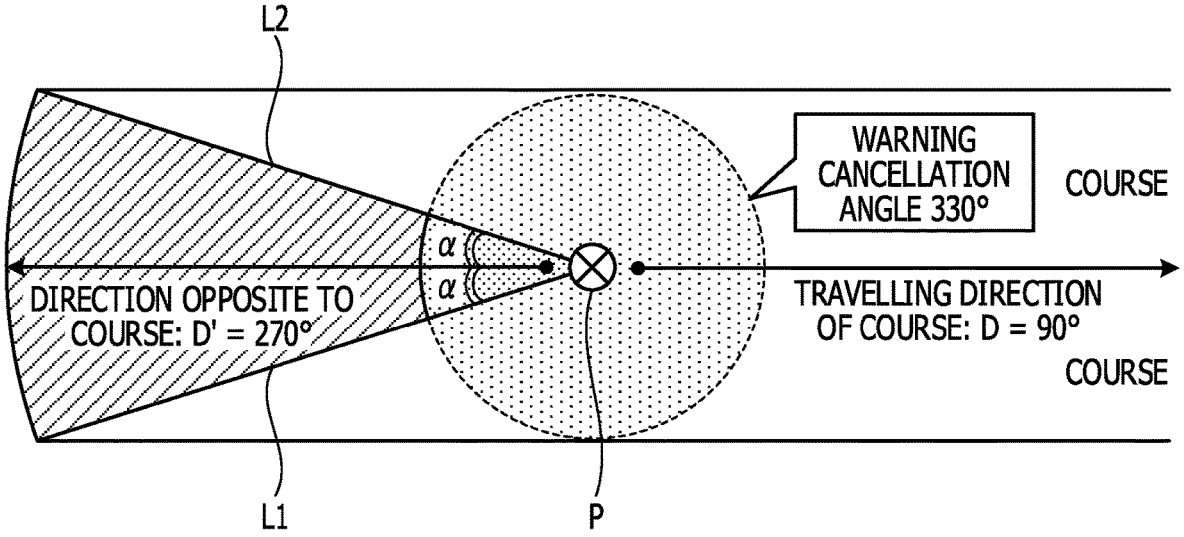
FIG. 6 is a diagram for description of an exemplary reverse-run identification range.

FIG. 6 is a diagram for description of an exemplary reverse-run identification range. FIG. 6 illustrates a case in which the traveling direction of the course is 90° when an azimuth is defined in the clockwise direction with 0° at the up direction, which is North, in FIG. 6. In FIG. 6, reference sign "P" denotes a position acquired as position information 30 seconds before. In addition, in FIG. 6, the reverse-run identification angle is illustrated with a densely dotted part, a non-reverse-run identification angle is illustrated with a sparsely dotted part, and the reverse-run identification range is illustrated with a hatched part.

As illustrated in FIG. 6, the course has a traveling direction D at the azimuth of 90°, and thus a direction D' opposite to the traveling direction D of the course is at the azimuth of 270°. Accordingly, the second detection unit 58*d* calculates the reverse-run identification angle to be an angle sandwiched between the azimuth of 255° and the azimuth of 285°, which are obtained by adding a predetermined allowable range±α, for example, ±15° to the opposite direction D' of the course. Then, the second detection unit 58*d* sets two border lines L1 and L2 that define the reverse-run identification range in accordance with the reverse-run identification angle with respect to the position P acquired as position information 30 seconds before. In the example illustrated in FIG. 6, the border line L1 defined by the azimuth of 255° with respect to the position P, and the border line L2 defined by the azimuth of 285° with respect to the position P are set. Then, the second detection unit 58*d* sets the reverse-run identification range to be the range sandwiched between the two border lines L1 and L2, in other words, the hatched part in FIG. 6.

After having set the reverse-run identification range, the second detection unit 58*d* determines whether the position information acquired by the acquisition unit 58*a*, in other words, the current position of the pleasure boat 5 is included in the reverse-run identification range. When the current position of the pleasure boat 5 is included in the reverse-run identification range, it is determined that the moving direction of the pleasure boat 5 is opposite to the traveling direction of the course.

In this case, the second detection unit 58*d* extracts a movement component in the direction opposite to the course from displacement between each pair of temporally sequential pieces of position information among a plurality of pieces of position information acquired over a predetermined past duration, for example, 30 seconds, including the position information acquisition by the acquisition unit 58*a*. Subsequently, the second detection unit 58*d* tallies the movement component in the opposite direction, which is extracted for each pair of pieces of position information. Then, the second detection unit 58*d* further determines whether the tallied value of the movement component in the opposite direction is equal to or larger than a predetermined threshold, for example, 30 m.

When the tallied value of the movement component in the opposite direction is equal to or larger than the threshold, it is determined that the moving direction of the pleasure boat 5 is opposite to the traveling direction of the course and the amount of movement in the opposite direction is large. In this case, the second detection unit 58*d* outputs a message telling reverse run in the course as an alert through display on the touch panel 51, or outputs a sound effect telling reverse run in the course or the above-described message as an alert by voice through a speaker (not illustrated) or the like. A diagram such as that illustrated in FIG. 6 does not necessarily have to be explicitly displayed on a screen, but the reverse-run identification range may be set through calculation by the second detection unit 58*d*.

The data communication unit 58*e* is a processing unit configured to perform communication such as data uploading and downloading with the server device 10.

According to the embodiment, when a port arrival operation or a port departure operation is received through the touch panel 51, the data communication unit 58*e* uploads a port departure notification or a port arrival notification to the server device 10. The data communication unit 58*e* also uploads, only during a sailing duration from reception of a port departure operation to reception of a port arrival operation through the touch panel 51, position information measured by the position detection unit 54 to the server device 10. The position information may be uploaded at each measurement of position information by the position detection unit 54, but may be uploaded in a period longer than a period in which the position detection unit 54 samples the position information. In addition, at each detection of reverse run by the second detection unit 58*d*, the data communication unit 58*e* uploads an alert execution notification including the kind of this alert, a marina ID, and a port departure ID to the server device 10. The data communication unit is an exemplary transmission unit.

[Processing Flow]

Figure 7:
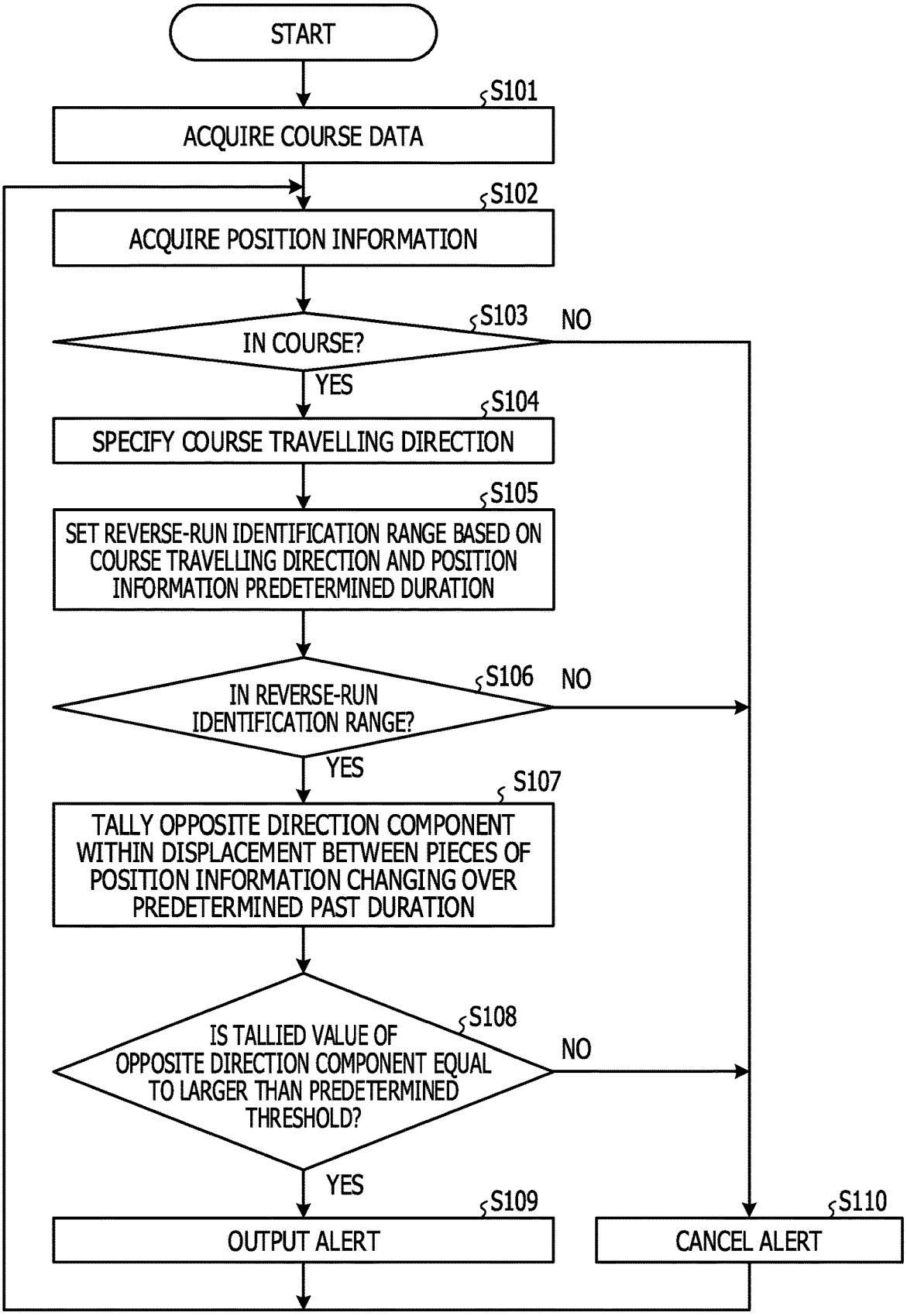
FIG. 7 is a flowchart illustrating the procedure of course reverse-run detection processing according to Embodiment 1.

FIG. 7 is a flowchart illustrating the procedure of the alert control processing according to Embodiment 1. For example, the processing is repeatedly executed during a sailing duration from reception of a port departure operation to reception of a port arrival operation through the touch panel 51. The following description will be made with an example in which port departure and port arrival events are received through the touch panel 51, but a sailing duration may be specified by automatically determining departure and arrival of the pleasure boat 5 from and at a port by using an existing technology.

As illustrated in FIG. 7, the specification unit 58*c* acquires the course data 56*b* stored in the storage unit 55 (step S101). Thereafter, the acquisition unit 58*a* acquires position information through the position detection unit 54 (step S102).

Subsequently, the specification unit 58*c* determines whether the position information acquired at step S102 is included in a navigation region included in the course data 56*b* acquired at step S101 (step S103). When the position information is included in the navigation region (Yes at step S103), it is identified that the current position of the pleasure boat 5 is in the course. In this case, the specification unit 58*c* specifies the traveling direction of the course associated with the navigation region in which the position information acquired at step S102 is included among traveling directions included in the course data 56*b* acquired at step S101 (step S104).

Then, the second detection unit 58*d* sets the reverse-run identification range based on the traveling direction of the course specified at step S104 and position information acquired by the acquisition unit 58*a*, for example, 30 seconds before the position information acquisition at step S102 (step S105).

Subsequently, the second detection unit 58*d* determines whether the position information acquired at step S102, in other words, the current position of the pleasure boat 5 is included in the reverse-run identification range set at step S105 (step S106). When the current position of the pleasure boat 5 is included in the reverse-run identification range (Yes at step S106), it is determined that the moving direction of the pleasure boat 5 is opposite to the traveling direction of the course.

In this case, the second detection unit 58*d* tallies a movement component in the opposite direction of the course, which is extracted for each pair of temporally sequential pieces of position information among a plurality of pieces of position information acquired over predetermined past duration, for example, 30 seconds including the position information acquisition at step S102 (step S107). Then, the second detection unit 58*d* further determines whether the tallied value of the movement component in the opposite direction, which is obtained at step S107 is equal to or larger than a predetermined threshold, for example, 30 m (step S108).

When the tallied value of the movement component in the opposite direction is equal to or larger than the threshold (Yes at step S108), it is determined that the moving direction of the pleasure boat 5 is opposite to the traveling direction of the course and the amount of movement in the opposite direction is large. In this case, the second detection unit 58*d* outputs a message telling reverse run in the course as an alert through display on the touch panel 51, or outputs a sound effect telling reverse run in the course or the above-described message as an alert by voice through a speaker (not illustrated) or the like (step S109), and the process transitions to step S102.

When the position information is not included in the navigation region (No at step S103), when the current position of the pleasure boat 5 is not included in the reverse-run identification range (No at step S106), or when the tallied value of the movement component in the opposite direction is smaller than the threshold (No at step S108), outputting of an alert related to course reverse run is canceled (step S110), and the process transitions to step S102. Specifically, when an alert related to course reverse run has been output based on position information sampled before position information sampling at step S102, the alert outputting is canceled. When no alert related to course reverse run has been output, the processing at step S110 is skipped.

[Aspects of Effects]

As described above, the navigation management support system 1 according to the present embodiment detects reverse run of a ship in a navigation region in which position information of the ship is included based on an angle between the direction of change in the position of the ship, which is determined from the locus of the position information and the traveling direction of the course, which is stored in association with the navigation region. Accordingly, the navigation management support system 1 according to the present embodiment is capable of detecting reverse run of a ship.

Embodiment 2

Although the embodiment related to devices according to the disclosure is described above, the present disclosure may be achieved in various kinds of different configurations other than the above-described embodiment. The following describes any other embodiment included in the disclosure.

[Processing Executor]

In Embodiment 1 described above, the processing illustrated in FIG. 7 is executed by the portable terminal device 50, but the executor of the processing is not limited to the portable terminal device 50. Specifically, the processing illustrated in FIG. 7 may be executed by the server device 10. In this case, the server device 10 may execute the navigation support App on a processor. Specifically, the server device 10 stores, in the storage unit 13, the navigation data 13*c* as distribution original data of the navigation support data 56. Accordingly, the server device 10 is capable of executing the processing illustrated in FIG. 7 through by periodically transmitting position information from the portable terminal device 50 to the server device 10 to prepare all data to be used in the processing illustrated in FIG. 7.

[Separation and Integration]

The components of each device illustrated in the drawings do not necessarily have to be physically configured as illustrated. Specifically, a specific configuration of separation and integration of the devices is not limited to that illustrated in the drawings, but all or part of the configuration may be functionally or physically separated or integrated in arbitrary units in accordance with, for example, various loads and use statuses. For example, the distribution unit 15*a*, the navigation recording unit 15*b*, the alert reception unit 15*c* or the map display unit 15*d* may be provided as an external device of the server device 10 and connected with the server device 10 through a network. In addition, part or all of the processing units included in the navigation support App execution unit 58 may be provided as external devices of the portable terminal device 50 and connected with the portable terminal device 50 through a network. For example, the server device 10 may include part of the processing units included in the navigation support APP execution unit 58.

[Reverse-Run Detection Program]

The various kinds of processing described in the above-described embodiments may be achieved by a computer, such as a personal computer or a work station, executing a computer program prepared in advance. The following describes, with reference to FIG. 8, an exemplary computer configured to execute a reverse-run detection program having functions same as those in the above-described embodiments.

Figure 8:
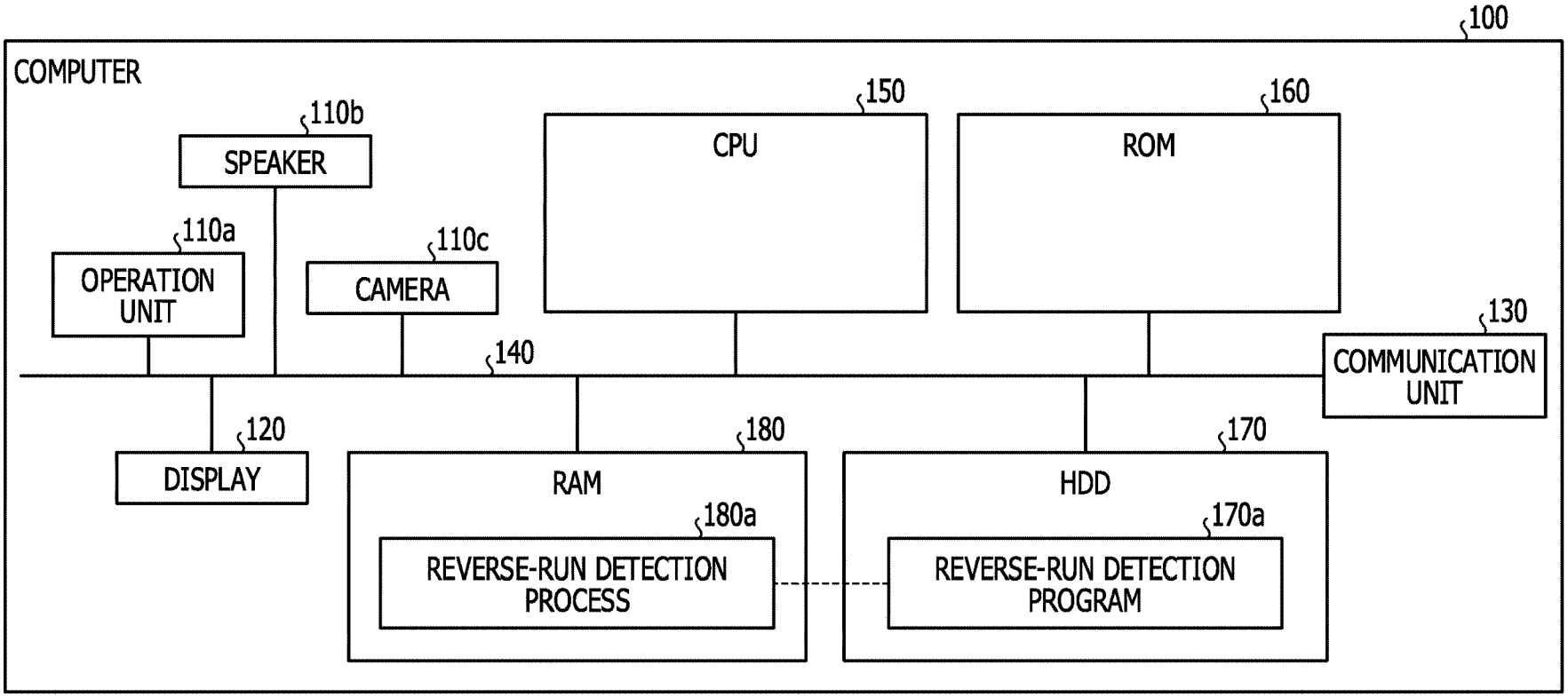
FIG. 8 is a diagram illustrating an exemplary hardware configuration of a computer configured to execute a reverse-run detection program according to Embodiments 1 and 2.

FIG. 8 is a diagram illustrating an exemplary hardware configuration of the computer configured to execute the reverse-run detection program according to Embodiments 1 and 2. As illustrated in FIG. 8, a computer 100 includes an operation unit 110*a*, a speaker 110*b*, a camera 110*c*, a display 120, and a communication unit 130. The computer 100 also includes a CPU 150, a ROM 160, a HDD 170, and a RAM 180. These components 110 to 180 are connected with each other through a bus 140.

As illustrated in FIG. 8, the HDD 170 stores a reverse-run detection program 170*a* configured to achieve a function same as that of the navigation support App execution unit 58 described above in Embodiment 1. Similarly to the components of the navigation support App execution unit 58 illustrated in FIG. 4, the reverse-run detection program 170*a* may be integrated or separated. Specifically, the HDD 170 does not necessarily have to store all data described above in Embodiment 1, but may only store data used in processing.

Under such an environment, the CPU 150 reads the reverse-run detection program 170*a* from the HDD 170 and then loads the reverse-run detection program 170*a* onto the RAM 180. As a result, as illustrated in FIG. 8, the reverse-run detection program 170*a* functions as a reverse-run detection process 180*a*. The reverse-run detection process 180*a* loads various kinds of data read from the HDD 170 onto a region allocated to the reverse-run detection process 180*a* among storage regions included in the RAM 180, and executes various kinds of processing by using the loaded various kinds of data. Examples of processing executed by the reverse-run detection process 180*a* include the processing illustrated in FIGS. 7 to 9. Not all processing units described above in Embodiment 1 necessarily have to operate on the CPU 150, but only a processing unit corresponding to processing to be executed may be virtually achieved.

The reverse-run detection program 170*a* does not necessarily have to be initially stored in the HDD 170 or the ROM 160. For example, each computer program may be stored in a "portable physical medium" such as a flexible disk (FD), a CD-ROM, a DVD disk, a magneto-optical disc, or an IC card to be inserted into the computer 100. Then, the computer 100 may acquire the computer program from the portable physical medium and execute the computer program. Alternatively, each computer program may be stored in another computer or a server device connected with the computer 100 through a public line, the Internet, a LAN, or a WAN, and the computer 100 may acquire the computer program from the other computer or the server device and execute the computer program.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A ship reverse-run detection system comprising:

a memory; and a processor coupled to the memory, wherein the processor is configured to:

acquire course data including a navigation region of a ship from a terminal device;

acquire first position information of the ship at a first time which is detected by a position detection device which is mounted on the ship;

detect, based on the first position information, whether a first position of the ship is within the navigation region;

specify a traveling direction associated with the navigation region by referring to a storage which stores the navigation region and the traveling direction in association with each other when the first position of the ship is within the navigation region;

set, as a reverse-run identification range, a region which is provided in an opposite direction to the traveling direction and is specified by two border lines which are specified by two symmetric angles with respect to a line which extends in a direction opposite to the traveling direction and extend from a second position of the ship indicated by second position information which is acquired at a second time which is before the first time;

determine whether the first position is within the reverse-run identification range;

extract movement components in the direction of respective pairs of two positions of the ship which are acquired in a predetermined past period including the second time when determining that the first position is within the reverse-run identification range;

determine whether a value which is obtained by tallying the movement components is equal to or larger than a threshold;

detect reverse run of the ship in the navigation region when determining that the value is equal to larger than the threshold; and output an alert indicating the reverse run of the ship when detecting the reverse run of the ship.

2. The ship reverse-run detection system according to claim 1, wherein the processor transmits, when the reverse run of the ship is detected, information indicating an occurrence of the reverse run and information of an identification of the ship regarding the reverse run to a specific destination as the alert.

3. The ship reverse-run detection system according to claim 1, wherein the processor detects the reverse run of the ship in the navigation region when the magnitude of an angle between a change direction of the ship and the traveling direction is within a specific range and a continuous migration length of the ship in the reverse-run identification range is a specific length or more.

4. The ship reverse-run detection system according to claim 3, wherein the specific length is 30 meters or more.

5. The ship reverse-run detection system according to claim 1, wherein the processor detects the reverse run of the ship in the navigation region when the magnitude of an angle between a change direction of the ship and the traveling direction is equal to or larger than a specific angle exceeding 90°.

6. The ship reverse-run detection system according to claim 1, wherein the processor detects the reverse run of the ship in the navigation region when the magnitude of an angle between a change direction of the ship and the traveling direction exceeds 160° or 165°.

7. A ship reverse-run detection method comprising:

acquiring, by a computer, course data including a navigation region of a ship from a terminal device;

acquiring first position information of the ship at a first time which is detected by a position detection device which is mounted on the ship;

detecting, based on the first position information, whether a first position of the ship is within the navigation region;

specifying a traveling direction associated with the navigation region, by referring to a storage which stores the navigation region and the traveling direction in association with each other when the first position of the ship is within the navigation region;

setting, as a reverse-run identification range, a region which is provided in an opposite direction to the traveling direction and is specified by two border lines which are specified by two symmetric angles with respect to a line which extends in a direction opposite to the traveling direction and extend from a second position of the ship indicated by second position information which is acquired at a second time which is before the first time;

determining whether the first position is within the reverse-run identification range;

extracting movement components in the direction of respective pairs of two positions of the ship which are acquired in a predetermined past period including the second time when determining that the first position is within the reverse-run identification range;

determining whether a value which is obtained by tallying the movement components is equal to or larger than a threshold;

detecting reverse run of the ship in the navigation region when determining that the value is equal to larger than the threshold; and outputting an alert indicating the reverse run of the ship when detecting the reverse run of the ship.

8. The ship reverse-run detection method according to claim 7, further comprising:

transmitting, when the reverse run of the ship is detected, information indicating an occurrence of the reverse run and information of an identification of the ship regarding the reverse run to a specific destination as the alert.

9. The ship reverse-run detection method according to claim 7, wherein the reverse run of the ship is detected in the navigation region when the magnitude of an angle between a change direction of the ship and the traveling direction is within a specific range and a continuous migration length of the ship in the reverse-run identification range is a specific length or more.

10. The ship reverse-run detection method according to claim 9, wherein the specific length is 30 meters or more.

11. The ship reverse-run detection method according to claim 7, wherein the reverse run of the ship is detected in the navigation region when the magnitude of an angle between a change direction of the ship and the traveling direction is equal to or larger than a specific angle exceeding 90°.

12. The ship reverse-run detection system according to claim 7, wherein the reverse run of the ship is detected in the navigation region when the magnitude of an angle between a change direction of the ship and the traveling direction exceeds 160° or 165°.

13. A non-transitory computer-readable recording medium storing a ship reverse-run detection program which causes a computer to execute a process, the process comprising:

acquiring, by a computer, course data including a navigation region of a ship from a terminal device;

acquiring first position information of the ship which is detected at a first time by a position detection device which is mounted on the ship;

specifying a traveling direction associated with the navigation region, by referring to a storage which stores the navigation region and the traveling direction in association with each other when the first position of the ship is within the navigation region;

setting, as a reverse-run identification range, a region which is provided in an opposite direction to the traveling direction and is specified by two border lines which are specified by two symmetric angles with respect to a line which extends in a direction opposite to the traveling direction and extend from a second position of the ship indicated by second position information which is acquired at a second time which is before the first time;

determining whether the first position is within the reverse-run identification range;

extracting movement components in the direction of respective pairs of two positions of the ship which are acquired in a predetermined past period including the second time when determining that the first position is within the reverse-run identification range;

determining whether a value which is obtained by tallying the movement components is equal to or larger than a threshold;

detecting reverse run of the ship in the navigation region when determining that the value is equal to lamer than the threshold; and outputting an alert indicating the reverse run of the ship when detecting the reverse run of the ship.

14. The non-transitory computer-readable recording medium according to claim 13, further comprising:

transmitting, when the reverse run of the ship is detected, information indicating an occurrence of the reverse run and information of an identification of the ship regarding the reverse run to a specific destination as the alert.

15. The non-transitory computer-readable recording medium according to claim 13, wherein the reverse run of the ship is detected in the navigation region when the magnitude of an angle between a change direction of the ship and the traveling direction is within a specific range and a continuous migration length of the ship in the reverse-run identification range is a specific length or more.

16. The non-transitory computer-readable recording medium according to claim 15, wherein the specific length is 30 meters or more.

17. The non-transitory computer-readable recording medium according to claim 13, wherein the reverse run of the ship is detected in the navigation region when the magnitude of an angle between a change direction of the ship and the traveling direction is equal to or larger than a specific angle exceeding 90°.

18. The non-transitory computer-readable recording medium according to claim 13, wherein the reverse run of the ship is detected in the navigation region when the magnitude of an angle between a change direction of the ship and the traveling direction exceeds 160° or 165°.

* * * * *